US009828304B1

(12) United States Patent
Haines et al.

(10) Patent No.: US 9,828,304 B1
(45) Date of Patent: Nov. 28, 2017

(54) COMPOSITES OF POROUS PYROPHORIC IRON AND CERAMIC AND METHODS FOR PREPARATION THEREOF

(71) Applicant: The United States of America as Represented by the Secretary of the Army, Washington, DC (US)

(72) Inventors: Christopher Haines, Union, NJ (US); Kendall Mills, Blairstown, NJ (US); Juan Patino, West Milford, NJ (US); Zac Doorenbos, Rapid City, SD (US); Jan Puszynski, Rapid City, SD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 15/133,489

(22) Filed: Apr. 20, 2016

Related U.S. Application Data

(60) Provisional application No. 62/150,458, filed on Apr. 21, 2015.

(51) Int. Cl.

| | |
|---|---|
| ***C06B 45/04*** | (2006.01) |
| ***D03D 23/00*** | (2006.01) |
| ***D03D 43/00*** | (2006.01) |
| ***F42B 5/15*** | (2006.01) |
| ***F42B 4/26*** | (2006.01) |

(52) U.S. Cl.
CPC ..... *C06B 45/04* (2013.01); *F42B 4/26* (2013.01); *F42B 5/15* (2013.01)

(58) Field of Classification Search
USPC ..... 149/17, 108.2, 108.6, 109.4, 109.6
See application file for complete search history.

(56) References Cited

U.S. PATENT DOCUMENTS

| | | | | |
|---|---|---|---|---|
| 4,895,609 | A | 1/1990 | Baldi | |
| 8,623,156 | B1 * | 1/2014 | Haines | C06B 45/14 149/108.2 |
| 2006/0042417 | A1 | 3/2006 | Gash | |

* cited by examiner

*Primary Examiner* — James McDonough
(74) *Attorney, Agent, or Firm* — Lisa H. Wang

(57) ABSTRACT

Disclosed herein are pyrophoric composite materials comprising nanoporous pyrophoric alpha iron nanoparticles dispersed in a ceramic matrix for use as aerial decoys. The composite material is prepared using tape casting methods to produce a thin film. The iron precursor in the film is then activated by reduction under a hydrogen atmosphere. The composite nanoporous pyrophoric alpha iron nanoparticles and ceramic material is an improvement over current pyrophoric decoys as it eliminates the use of harmful chemicals and the need for a substrate to support the composite.

15 Claims, 4 Drawing Sheets

COMPOSITES OF POROUS PYROPHORIC IRON AND CERAMIC AND METHODS FOR PREPARATION THEREOF

CROSS REFERENCE TO RELATED APPLICATIONS

The present application is a non-provisional application that claims the benefit of provisional application entitled "Ceramic Bonded Pyrophoric Substrates" filed on Apr. 21, 2015 as Ser. No. 62/150,458 the disclosure of which is incorporated in its entirety herein.

RIGHTS OF THE GOVERNMENT

The inventions described herein may be manufactured and used by or for the United States Government for government purposes without payment of any royalties.

FIELD OF INVENTION

The present invention relates generally to aerial countermeasures and more specifically to iron/ceramic composite pyrophoric materials used as such decoys along with methods for preparation thereof.

BACKGROUND OF THE INVENTION

Decoy flares are countermeasures ejected from an aircraft to mislead a missile's infrared or heat seeking guidance system to target the flares rather than the aircraft. Decoy flares may be categorized as pyrotechnic or pyrophoric. Pyrotechnic flares use a slow burning fuel/oxidizer combination to generate intense heat to attract the missiles. In contrast, pyrophoric flares self-ignite when exposed to oxygen in the air. When the pyrophoric material is ejected from an aircraft, it is designed to flutter in the air due to the high surface area to mass ratio of the pyrophoric material. This allows the pyrophoric material to disperse in a cloud like pattern thereby mimicking an aircraft's fuel exhaust or hot engine components.

Conventional methods for the preparing pyrophoric countermeasures rely on chemical leaching techniques for the formation of high specific surface area metal substrates that are reactive to oxygen. U.S. Pat. No. 4,895,609 issued to Baldi et al, discloses current methods for preparing iron coated on steel pyrophoric materials. The methods generally requires:

a. Mixing iron and aluminum powders in a slurry containing a suitable solvent and binder. Then applying the mix onto a very thin steel foil by dip coating or spraying.
b. The resulting material is heated to 500° C. to evaporate the solvent and binder to yield a coat of metallic powder on the steel foil.
c. The coated substrate is further heated to a high temperature of 800° C. to 1000° C. in a reducing atmosphere such as hydrogen or argon to form an iron/aluminum alloy.
d. The aluminium from the resulting alloy is then leached with highly concentrated, hot sodium hydroxide (NaOH) solution to form highly pyrophoric, porous iron.

The Baldi method utilizes chemical leaching to prepare porous iron which requires use of high concentrations of hot, corrosive NaOH solution. Handling of such caustic materials increases safety risks to the user as NaOH has been known to cause permanent damage to human tissue. Sodium hydroxide is also designated as a hazardous environmental substance under the Federal Water Pollution Act and Clean Water Act.

U.S. Pat. No. 8,623,156 issued to Haines et al, addresses alternative methods for preparing pyrophoric foils without the use of chemically hazardous materials like NaOH. The patent discloses methods for water based processing followed by hydrogen reduction of iron oxide to form pyrophoric nano-iron on various types of ceramic, metal, and nanomaterial substrates. Similar to Baldi, the Haines' '156 patent also requires an underlying substrate to provide structural integrity to the pyrophoric material.

U.S. Patent application publication number 20060042417 by Gash et al, discloses sol-gel methods to generate high surface area porous iron for making pyrophoric substrates. This method avoids the use of NaOH, however, poor adhesion of the particles to the substrates were noted on porous substrates and no significant pyrophoric response was generated on the spin-coated, non-porous substrates. It is believed that this lack of response is due to the amount of material coated on the surface of the steel substrate and the high thermal conductivity of the steel substrate causing the quenching of the oxidation reaction from heat loss.

Thus a need exists for safer, environmentally benign, and more efficient methods for preparing pyrophopric materials that provides the same performance standards as current iron coated on steel pyrophopric decoys.

SUMMARY OF THE INVENTION

Disclosed herein are composite materials for use in countermeasure decoys. In one embodiment, the composite material comprises nanoporous pyrophoric alpha iron nanoparticles dispersed in a ceramic matrix, wherein the ratio of the iron to ceramic is 41:59 to 93:7.

In one feature of this embodiment, the composite material comprises a fuel.

In yet another feature of this embodiment, the ceramic material is porous and has a porosity of between 10% to 40%.

In another embodiment, the composite material is shaped into strips and packaged into canisters for use as an aerial countermeasure decoy.

In yet another embodiment, a process is disclosed for preparing the composite material. The process comprises mixing alpha iron oxide nanoparticles, a ceramic material, and an optional binder with a liquid to create a free-flowing slurry. The slurry is tape casted into a thin flat film and dried. The thin flat film is further sintered and reduced under hydrogen gas to activate the alpha iron nanoparticles into pyrophoric alpha iron nanoparticles.

BRIEF DESCRIPTION OF THE DRAWINGS

The invention will be better understood, and further objects, features and advantages thereof will become more apparent from the following description of the preferred embodiments, taken in conjunction with the accompanying drawings.

DETAILED DESCRIPTION

The present invention discloses a pyrophoric composite material useful as countermeasure decoys and methods for preparing the same. The methods provided herein eliminates the need for using caustic chemicals for preparing nanoporous pyrophoric alpha iron nanoparticles. The disclosed method has the added benefit of a self-supporting matrix, thereby eliminating the need for a substrate. The process utilizes resonant acoustic mixing to disperse alpha iron oxide nanoparticles and ceramic into a mixture. The mixture is then tape casted into a desired thickness. The alpha iron oxide dispersed in the ceramic is then reduced to convert alpha iron oxide into porous pyrophoric alpha iron nanoparticles. The pyrophoric response of the iron can be adjusted (i.e. tuned) based on the iron/ceramic material weight ratio and/or the addition of other fuels such as Mg, Al etc.

As used herein, the term pyrophoric means the ability to self-ignite spontaneously upon exposure to air.

The general processing steps for preparing the nanoporous pyrophoric alpha iron nanoparticles and ceramic composite material is as follows:

a. Preparing a mixture by dispersing alpha iron oxide nanoparticles, ceramic material, a liquid solvent and optional additives to form a slurry.
b. Tape casting and drying the slurry mix into a desired thickness.
c. Sintering the composite material to strengthen the tape casted mixture.
d. Reducing the alpha iron oxide to form nanoporous pyrophoric alpha iron metal dispersed in a ceramic matrix.

Figure 1:
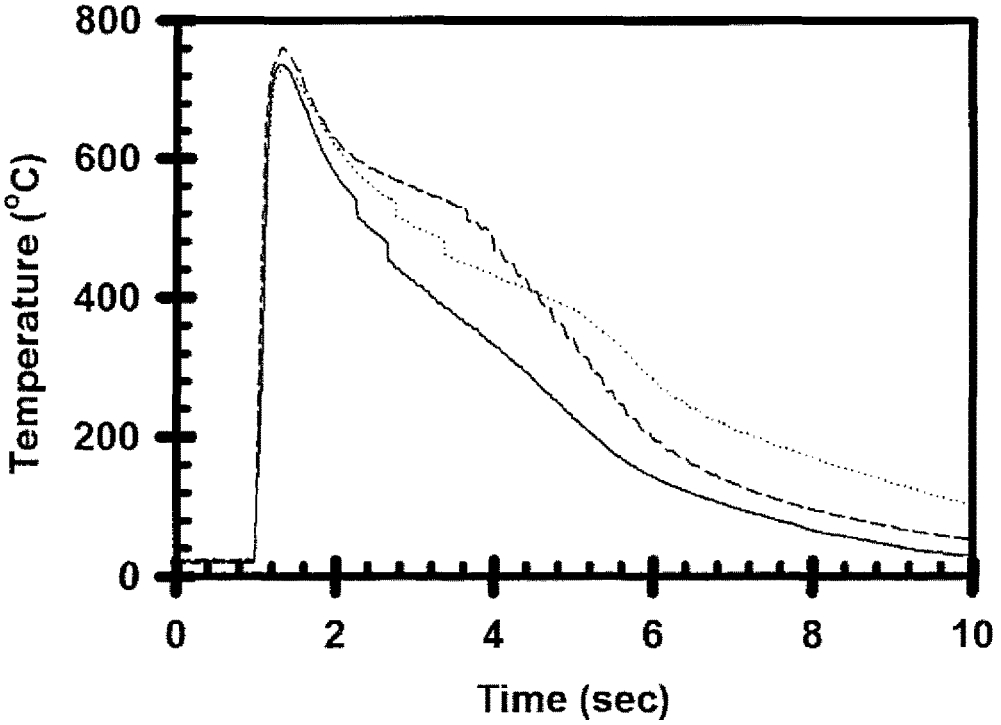
FIG. 1. Pyrophoric response of three separate iron/aluminum silicate composites exposed to flowing air.

The composite material prepared by the process described herein comprises nanoporous pyrophoric alpha iron nanoparticles wherein the alpha iron spontaneously self-ignites upon exposure to air. The nanoporous pyrophoric alpha iron nanoparticles are dispersed in an interconnected matrix of porous ceramic material. It should be understood that the ceramic material should be sufficiently porous to permit oxygen in the atmosphere to permeate and react with the pyrophoric alpha iron disperse through the entire structure such that spontaneous self-ignition of the iron is achieve at under 2 seconds, with output temperatures reaching as high as about 600° C. to about 800° C. as illustrated in FIG. 1. The density of the composite material should be adjusted such that the material flutters like confetti when expelled from an aircraft. Recommended porosity of the ceramic material in the composite is about 10% to 40%, and preferably about 20% to 30%.

Composite Mix.

Alpha iron oxide nanoparticles and ceramic material, at ratio of 50:50 to 90:10 by weight, may be dispersed with liquid into a free flowing slurry. The materials may be uniformly mixed using any known methods that produces a homogenous mixture. Resonant acoustic mixer (RAM) is preferred. Such mixers are available from Resodyn Acoustic®. Nanoparticles of alpha iron oxide having a size no greater than 100 nm and preferably between 20 nm-60 nm may be used. The liquid may be water or an organic solvent, however, any liquid that promotes flowability of the slurry during the tape casting process may be utilized. A preferred liquid is water. Ceramic material such as aluminum silicate may be mixed with the alpha iron oxide nanoparticle, however, sodium silicate, lithium silicate, magnesium silicate, bentonite, montmorillonite, Boehmite, and feldspar may be used as well. Polymeric binders may optionally be added to the mixture. Such binders include methylcellulose, hydroxypropyl methylcellulose, and ethylcellulose as well as other high viscosity binders soluble in the selected solvent may be used. Fuel components may optionally be added to modify the dynamic combustion of the self-supporting pyrophoric material. Such fuel additives include aluminum, silicon, tin and magnesium with tin being preferred.

Figure 2:
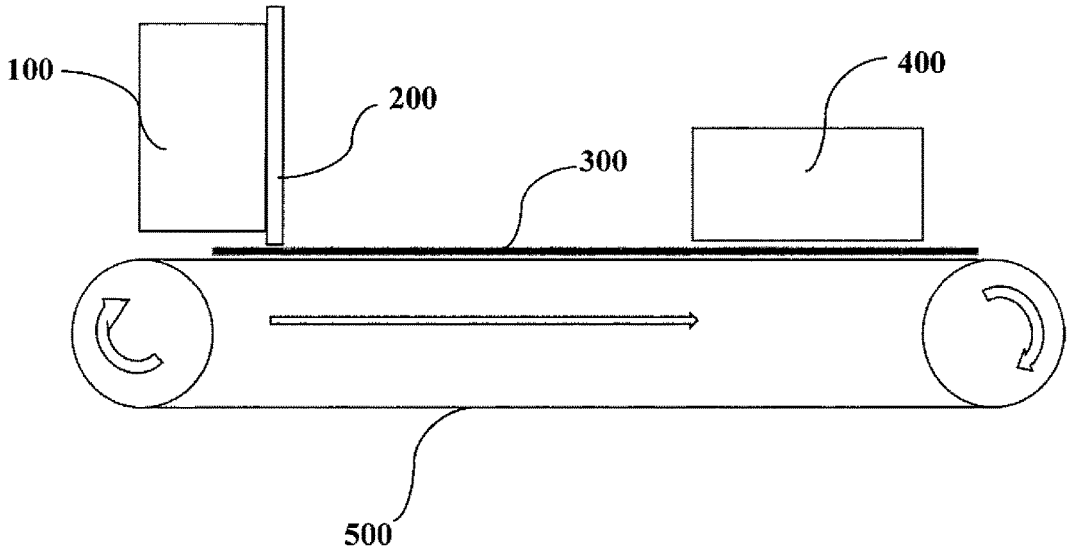
FIG. 2. Exemplary tape casting machine assembly.

Tape casting. After the composite slurry is prepared, it may be tape casted using an apparatus having the general features illustrated in FIG. 2. Generally, the composite slurry is placed into a holding chamber 100 having a gap controlled by a doctor blade 200. The composite slurry passes under the doctor blade which spreads the slurry into a thin, flat, even, tape-like layer having a thickness of about 0.002" to about 0.2" and preferably about 0.045". The tape-like composite 300 exiting the doctor blade rests atop a nonstick plate or platform which is moved by a conveyor system 500 to a heating element assembly 400 to remove the liquid dispersant. Recommended drying conditions of 70°–72° F., 15%-25% relative humidity for 16 hours may be used, however, these drying conditions may be adjusted to avoid cracks or surface stress on the composite material. A final thickness of 0.014" to 0.028" composite material tape/film is recommended to maintain structural integrity of the material. The thickness of the film may be adjusted to control the burn time of the pyrophoric material. After the composite tape is dried, it may be cut to the desired shape and length, or spooled for storage and further processing.

Sintering.

The composite tape is further processed by partial sintering to remove the binder, initiate inter-particle connections, and reduce the porosity which all leads to increased strength. Sintering of the composite is conducted at temperatures between 980° C. to 1200° C. with soak times between 10 minutes and 5 hours in air or under an inert atmosphere. The temperature and soak times may be varied, in accordance with generally known methods.

Iron Reduction.

Figure 3:
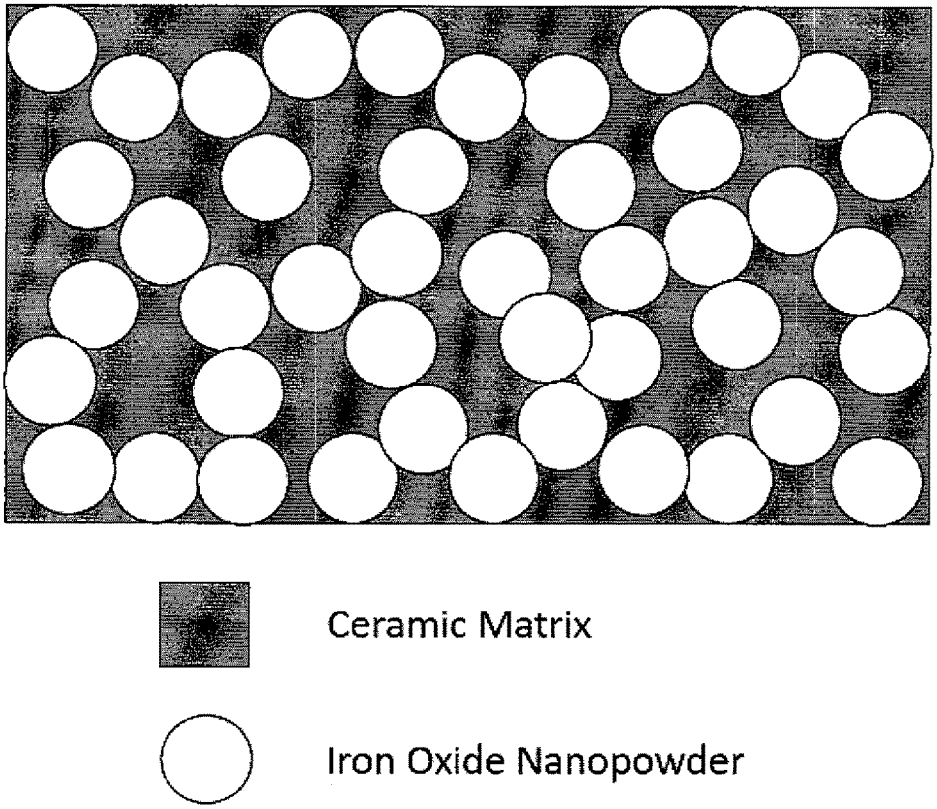
FIG. 3. Illustration of a pre-reduction alpha iron oxide and ceramic composite.
Figure 4:
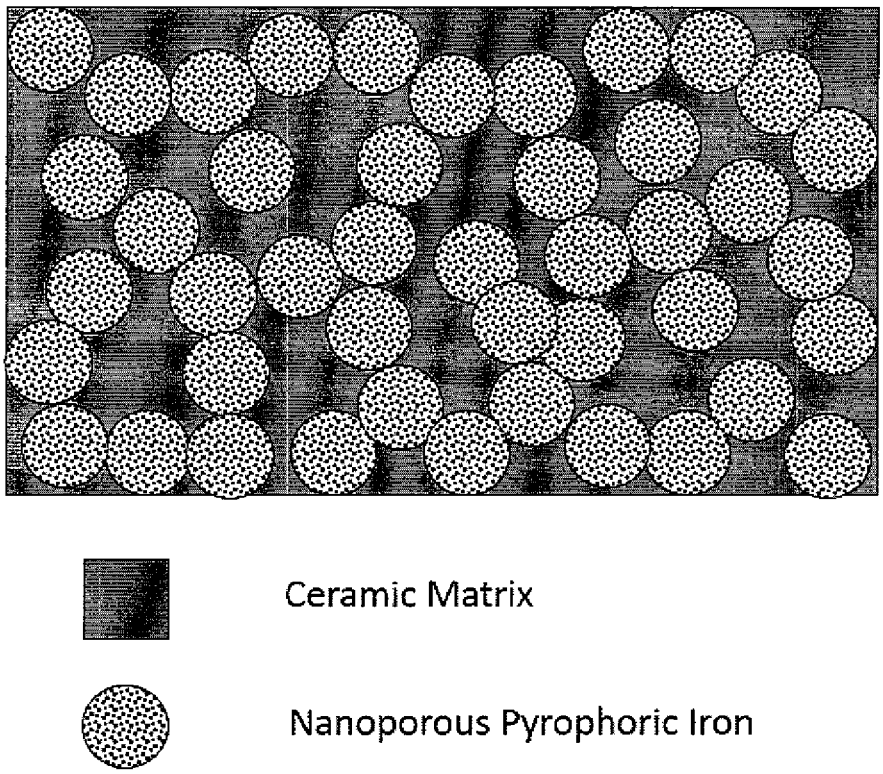
FIG. 4. Illustration of a post-reduction nanoporous alpha iron nanoparticles and ceramic composite.

The alpha iron oxide in the composite material is reduce to nanoporous pyrophoric alpha iron nanoparticles using hydrogen to produce water as a byproduct in this step. Reduction of alpha iron occurs under a flowing hydrogen environment, preferably at temperatures of 400° C. to 550° C. for a minimum of 3 hours. The reduced composite is then cooled under a flowing hydrogen, nitrogen or a mixed hydrogen/nitrogen atmosphere. FIG. 3 and FIG. 4 are illustrations of iron oxide in the ceramic matrix before reduction and after reduction respectively.

Packaging.

The iron and ceramic composite tape or film may be further processed into strips and packaged as a plurality of geometric shaped strips under a dry inert atmosphere (hydrogen and/or nitrogen) into canisters that can be ejected from an aircraft. Typical geometric shape strips include 1"×1" squares packaged into a canister having inner dimensions of 1"×1"×8".

EXAMPLE 1

Example 1 is an illustration of the disclosed invention. Weighing out of the following components: i) alpha iron oxide (27 grams), ii) aluminum silicate (3 grams) iii) methylcellulose (1.5 grams) and iv) water (67.5 mL). In certain cases, additional fuels such as Al, Mg, Ti etc. may be added to the mixture. Disperse the methylcellulose powder in the water and allow for complete hydration of the methylcellulose over a 16-hour period. Add the alpha iron oxide and aluminum silicate to the mixing container containing the methylcellulose solution and disperse using an acoustic mixing technique. The composite slurry is then tape casted onto a Teflon or other suitable non-sticking plate or film using a doctor blade. The composite tape is allowed to dry for 12 hours under ambient conditions. The composite tape is then cut into pieces (size dependent on end application). The substrates are sintered in air at 10-15° C. above the silicate melting point with a soak time of 10 minutes to 3 hours. Hydrogen reduction of the alpha iron oxide is conducted, followed by testing or packaging. FIG. 1 is a chart of the pyrophoric response for the composite material prepared by Example 1.

EXAMPLE 2

In another example, 80% alpha iron oxide nanoparticles and 20% sodium silicate by weight were dispersed in water. The mixture was tape casted as described in the procedures above and sintered at 1100° C. for 30 minutes and further reduced under flowing hydrogen.

Although the subject invention has been described above in relation to embodiments thereof, it will be understood by those skilled in the art that variations and modifications can be effected in these preferred embodiments without departing from the scope and spirit of the invention.

What is claimed is:

1. A composite material for use as an aerial countermeasure decoy comprising, nanoporous pyrophoric alpha iron nanoparticles dispersed in a ceramic matrix, wherein said composite material is monolithic.

2. The composite material of claim 1, wherein the ratio of the nanoporous pyrophoric alpha iron nanoparticles to the ceramic matrix is 41:59 to 93:7.

3. The composite material of claim 1, wherein the ceramic matrix is porous and having a porosity of between 10% to 40%.

4. The composite material of claim 1 wherein the ceramic is selected from the group consisting of aluminum silicate, sodium silicate, lithium silicate, magnesium silicate, bentonite, montmorillonite, Boehmite, and feldspar.

5. The composite material of claim 1 further comprising a fuel selected from group consisting of aluminum, silicon, tin and magnesium.

6. A composite material for use as a countermeasure decoy consisting essentially of, nanoporous pyrophoric alpha iron nanoparticles dispersed in a ceramic matrix, wherein said composite material is monolithic and a fuel wherein said fuel is selected from the group consisting of aluminum, silicon, tin and magnesium.

7. A canister comprising a plurality of thin flat composite material of claim 1 in an inert atmosphere.

8. A process for preparing the composite material of claim 1, comprising:

preparing a slurry comprising alpha iron oxide nanoparticles and ceramic material dispersed in a liquid, wherein the ratio of alpha iron oxide nanoparticles to ceramic material is 50:50 to 90:10 by weight;

tape casting the slurry into a thin flat material;

drying the thin flat material to remove the liquid dispersant;

sintering the thin flat material; and reducing the thin tape material under a hydrogen atmosphere to produce nanoporous pyrophoric alpha iron nanoparticles dispersed in a porous ceramic matrix.

9. The process of claim 8, wherein the ceramic material is aluminum silicate.

10. The process of claim 8, wherein the ceramic material is selected from the group consisting of sodium silicate, lithium silicate, magnesium silicate, bentonite, montmorillonite, Boehmite, and feldspar.

11. The process of claim 8, further comprising a binder selected from the group consisting of methylcellulose, hydroxypropyl methylcellulose, and ethylcellulose.

12. The process of claim 8, further comprising a fuel selected from the group consisting of aluminum, silicon, tin and magnesium.

13. The process of claim 8, wherein the liquid dispersant is water or alcohol.

14. The process of claim 8, wherein the thin flat material is about 0.014 inches to about 0.028 inches thick.

15. The process of claim 8, wherein the alpha iron oxide nanoparticle and ceramic material is dispersed using a resonant acoustic mixer.

* * * * *